US007738801B2

(12) United States Patent
Sasaki

(10) Patent No.: US 7,738,801 B2
(45) Date of Patent: Jun. 15, 2010

(54) IMAGE FORMING APPARATUS AND IMAGE FORMING SYSTEM

(75) Inventor: Miho Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 150 days.

(21) Appl. No.: 12/068,562

(22) Filed: Feb. 7, 2008

(65) Prior Publication Data

US 2008/0240746 A1 Oct. 2, 2008

(30) Foreign Application Priority Data

Mar. 28, 2007 (JP) ..... 2007-084237

(51) Int. Cl.
*G03G 15/08* (2006.01)
*G03G 15/00* (2006.01)
*G03G 15/10* (2006.01)
*G03G 15/04* (2006.01)

(52) U.S. Cl. ..... 399/27; 399/24; 399/59; 399/61; 399/119

(58) Field of Classification Search ..... 399/27, 399/29, 30, 61, 59, 23, 24, 119
See application file for complete search history.

(56) References Cited

U.S. PATENT DOCUMENTS

2006/0051106 A1* 3/2006 Takahashi et al. ..... 399/12

FOREIGN PATENT DOCUMENTS

| | | |
|---|---|---|
| JP | A-08-160732 | 6/1996 |
| JP | A-2004-347931 | 12/2004 |
| JP | A-2004-347932 | 12/2004 |

* cited by examiner

*Primary Examiner*—David M Gray
*Assistant Examiner*—Rodney Bonnette
(74) *Attorney, Agent, or Firm*—Oliff & Berridge, PLC

(57) ABSTRACT

An image forming apparatus includes a developing device, a replaceable developing material container that contains developing material, a coupling member that couples the developing device to the developing material container, and a controller. The controller calculates a value obtained by calculating replacement time of the developing material container, on a developing material amount obtained by subtracting a developing material amount filled in the coupling member from a developing material amount contained in the attached developing material container, when the developing material container is attached and an installation sequence to fill the coupling member with developing material is performed. The image forming apparatus further includes a display that displays information indicating the replacement time of the developing material container based on the value calculated by the controller.

15 Claims, 11 Drawing Sheets

PRELIMINARY WARNING THRESHOLD VALUE CALCULATION PROCESSING (S10)

STATUS DETECTION PROCESSING (S20)

STATUS DISPLAY PROCESSING (S30)

STATUS-BASED CONTROL PROCESSING (S40)

TONER AMOUNT ESTIMATION PROCESSING IN COUPLING MEMBER (S50)

IMAGE FORMING APPARATUS AND IMAGE FORMING SYSTEM

CROSS-REFERENCE TO RELATED APPLICATIONS

This application is based on and claims priority under 35 USC 119 from Japanese Patent Application No. 2007-084237 filed Mar. 28, 2007.

BACKGROUND

1. Technical Field

The present-invention relates to an image forming apparatus and an image forming system.

2. Related Art

Generally, an image forming apparatus is often provided with a replaceable toner cartridge. As this type of image forming apparatus, an apparatus in which the life of such toner cartridge is detected is known.

SUMMARY

According to an aspect of the invention, there is provided an image forming apparatus including: a developing device; a replaceable developing material container that contains developing material; a coupling member that couples the developing device to the developing material container; a controller that, when the developing material container is attached and an installation sequence to fill the coupling member with developing material is performed, calculates a value obtained by performing an operation to calculate replacement time of the developing material container, on a developing material amount obtained by subtracting a developing material amount filled in the coupling member from a developing material amount contained in the attached developing material container; and a display that displays information indicating the replacement time of the developing material container based on the value calculated by the controller. According to the aspect of the present invention, even when the developing material is included in the coupling member connecting the developing device to the developing material container, a toner consumption amount can be exactly detected.

BRIEF DESCRIPTION OF THE DRAWINGS

Exemplary embodiments of the present invention will be described in detail based on the following figures, wherein.

DETAILED DESCRIPTION

First, an image forming apparatus 10 according to a first exemplary embodiment of the present invention will be described.

Figure 1:
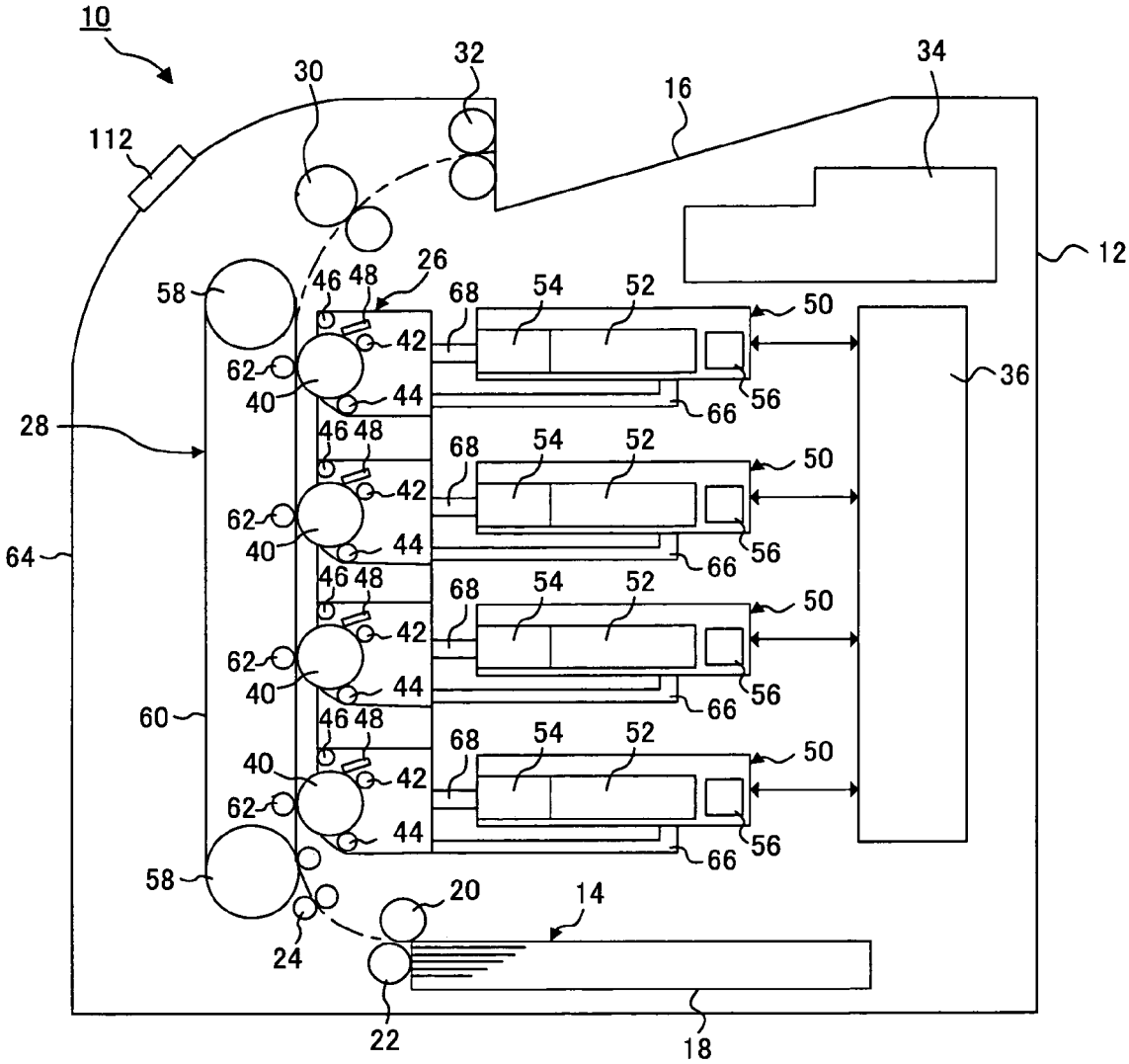
FIG. 1 is a cross-sectional view showing an image forming apparatus 10 according to a first exemplary embodiment of the present invention.

FIG. 1 is a cross-sectional view showing the image forming apparatus 10 according to exemplary embodiments of the present invention.

As shown in FIG. 1, the image forming apparatus 10 has an image forming apparatus main body 12. A paper feeder 14 is provided in a lower part of the image forming apparatus main body 12, and a paper discharge unit 16 is formed in an upper part of the image forming apparatus main body 12. Further, a rotatable open-close cover 64 and a user interface (UI) 112 are provided on the surface side of a side surface of the image forming apparatus main body 12.

The UI 112, having a touch panel or buttons, a liquid crystal display and the like, receives a user's input and outputs it to a controller 36 to be described later. Further, the UI 112 displays a display content designated by the controller 36.

The paper feeder 14 has a paper tray 18 on which a large number of paper sheets are stacked. A feed roller 20 is provided in an upper end position of the paper tray 18, and a retard roller 22 is provided in a position opposite to the feed roller 20. A top sheet on the paper tray 18 is picked up with the feed roller 20, retarded by cooperation between the feed roller 20 and the retard roller 22, and conveyed.

The sheet conveyed from the paper tray 18 is temporarily stopped with a registration roller 24, and passed between an image holder unit 26 to be described later and a transfer unit 28 and through a fixing device 30 and discharged with a paper discharge roller 32 to the paper discharge unit 16 at predetermined timing. Note that the sheet is not limited to a paper medium but may be an OHP sheet or the like.

The image holder unit 26, the transfer unit 28, a power source unit 34 and a controller 36 are provided in the image forming apparatus main body 12. The image holder unit 26 is attachable/removable to/from the image forming apparatus main body 12. The image holder unit 26 is attached/removed via an opening opened/closed by opening/closing an open-close cover 64.

The image holder unit 26 rotatably supports, e.g., four image holders 40. The image holder 40 holds an image transferred onto a conveyance belt 60 to be described later or a sheet conveyed with the conveyance belt 60. A charging device 42 as a charger having a charging roller to uniformly charge the image holder 40, a developing device 44 to develop a latent image written on the image holder 40, a diselectrifying device 46 to diselectrify the image holder 40 after transfer, and a cleaning device 48 as a developing material removal unit to remove developing material remaining on the image holder 40 after the transfer, are provided around each image holder 40.

A developing material container 50 has a supplied developing material container 52 and a recovered developing material container 54 integrated with each other. The developing material container 50 is provided with a memory chip 56. The developing material container 50 is removably attached to the image forming apparatus main body 12, and is connected to the side of the rear surface side of the image holder unit 26. For example, four developing material containers 50 for magenta, yellow, cyan and black toner are projected. Note that the developing material container 50 is also referred to as a "toner box", and the supplied developing material container 52 is also referred to as a "toner bottle". Further, the supplied developing material contained in the supplied developing material container 52 and the recovered developing material contained in recovered developing material container 54 are also referred to as "toner" and "waste toner".

A first coupling member 66 couples the supplied developing material container 52 to the developing device 44. Accordingly, the supplied developing material container 52 is connected via the first coupling member 66 to the developing device 44. The first coupling member 66 is provided with, e.g., a screw conveyance member. A second coupling member 68 couples the cleaning device 48 to the recovered developing material container 54. Accordingly, the recovered developing material container 54 is connected via the second coupling member 68 to the cleaning device 48.

A memory chip 56 has a rewritable storage device such as a NVM (Non Volatile Memory)(not shown), a transmission unit, a reception unit, a power source unit, an antenna and the like. The memory chip 56 having the above configuration transmits/receives an electric wave signal to/from a radio communication controller 108 to be described later provided in the image forming apparatus main body 12, stores data included in the electric wave signal into the storage device, and transmits data stored in the storage device to the radio communication controller 108.

The memory chip 56 holds a serial number to uniquely identify the developing material container 50, date of manufacture, a ratio for calculation of replacement time of the developing material container 50 (e.g., a preliminary warning ratio to be described later) and the like. Further, the memory chip 56 may hold replacement time (e.g., a preliminary warning threshold value, a warning threshold value and life over threshold value to be described later) of the developing material container 50 calculated by the controller 36. Note that the memory chip 56 may hold related information available to grasp the status of the developing material container 50 and its record such as a life count value indicating the amount of use from the start of use to the current time, the number of revolutions of the image holder 40 and the like. Further, the replacement time is also referred to as a "life".

Optical writing devices (not shown), respectively having a laser exposure device, are provided in positions corresponding to the respective image holders 40 on the rear surface side of the image holder unit 26. The optical writing devices emit laser to the uniformly charged image holders 40 thereby form latent images.

The transfer unit 28 is provided in a vertical direction in a position opposite to the image holder unit 26 on the front side of the image holder unit 26. In the transfer unit 28, the conveyance belt 60 is put on two support rollers 58 provided in the vertical direction. The conveyance belt 60 conveys an image or a sheet. Further, a transfer roller 62 is provided on the respective image holders 40 with the conveyance belt 60 between the transfer roller and the respective image holders 40.

Accordingly, as the conveyance member provided in the first coupling member 66 is driven and rotated, the toner of respective colors is supplied from the supplied developing material container 52 of the developing material container 50 to the developing device 44 in the image holder unit 26. On the respective image holders 40 uniformly charged by the charging device 42, latent images are formed by the optical writing devices, and the latent images are visualized with toner by the developing devices 44. The toner images formed on the image holders 40 are transferred onto a sheet conveyed with the conveyance belt 60 in the transfer unit 28, and fixed to the sheet by the fixing device 30. Further, waste toner of respective color is removed by the cleaning devices 48, and recovered in the recovered developing material container 54 of the developing material container 50.

Note that the recovered developing material container 54 may be further provided in the image forming apparatus main body 12. In this case, waste toner is removed from, e.g., the image holder unit 26 and the transfer unit 28, and recovered into the recovered developing material container 54 provided in the image forming apparatus main body 12.

Further, the UI 112 may be a display and an input device such as a keyboard, a mouse and the like of an external computer connected via the network. In this case, a predetermined setting screen is displayed by, e.g., driver software on the display of the computer. Accordingly, an input via such setting screen is received by the computer as the UI 112, then transmitted via the network to the controller 36 of the image forming apparatus 10.

Figure 2:
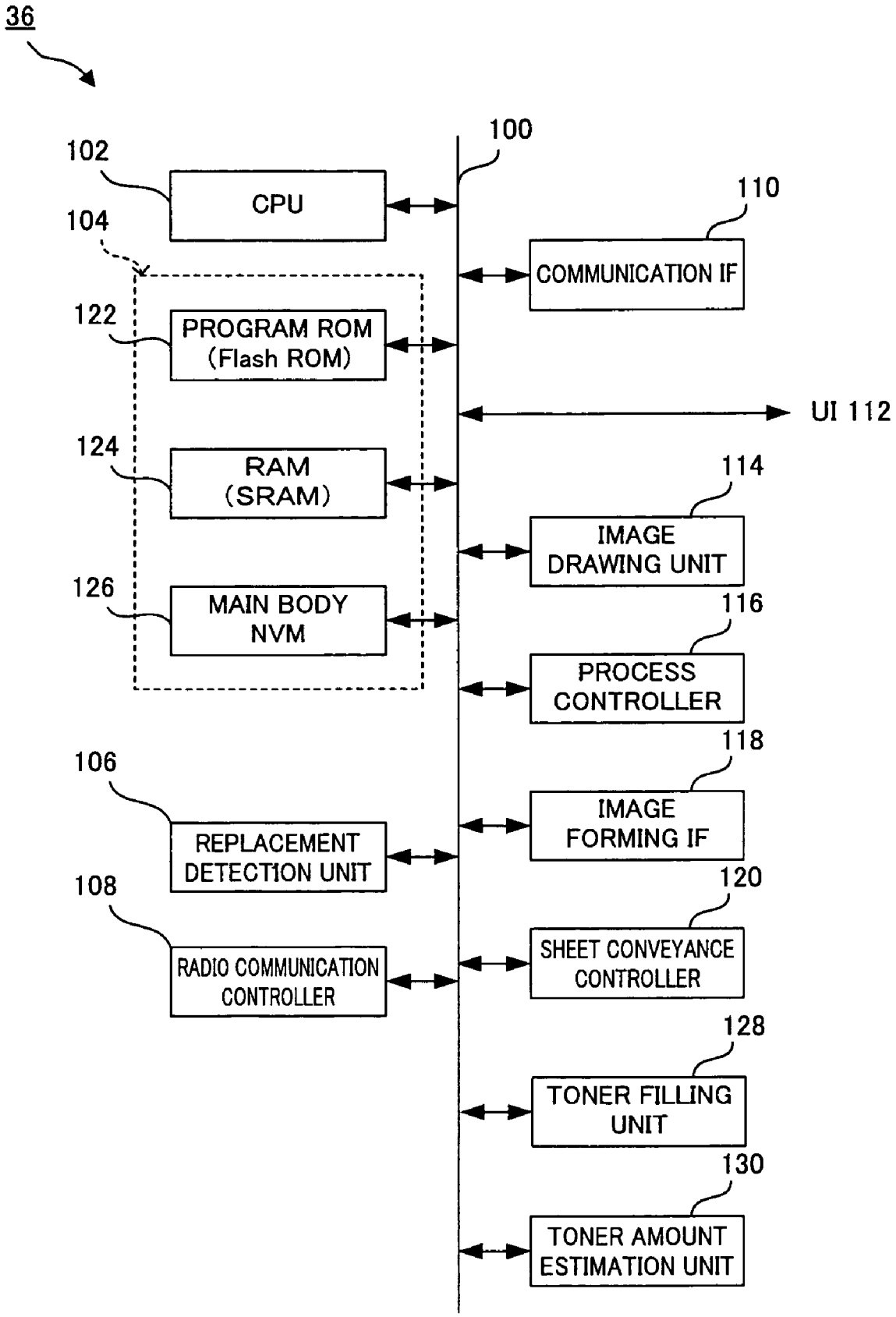
FIG. 2 is a block diagram showing the configuration of a controller 36 in the image forming apparatus 10.

FIG. 2 is a block showing the configuration of the controller 36.

As shown in FIG. 2, the controller 36 has a CPU 102, a storage unit 104, a replacement detection unit 106, a radio communication controller 108, a communication interface (IF) 110, an image drawing unit 114, a process controller 116, an image forming IF 118, a sheet conveyance controller 120, a toner filling unit 128 and a toner amount estimation unit 130. These elements input/output signals to/from each other via a bus 100.

The CPU 102 transmits/receives signals to/from the respective constituent elements of the controller 36 via the bus 100, thereby controls the respective constituent elements of the controller 36. The storage unit 104, having a program ROM 122, a RAM 124 and a main body NVM (Non Volatile Memory) 126, holds information necessary for control of the image forming apparatus 10.

The replacement detection unit 106 detects replacement of a replacement unit such as the developing material container 50, the image holder unit 26 or the transfer unit 28, and outputs a signal informing the replacement to the CPU 102. The radio communication controller 108 having an antenna (not shown) transmits/receives a signal to/from the memory chip 56 provided in the developing material container 50, and transmits/receives signals to/from the CPU 102, the storage unit 104 and the like via the bus 100.

The communication IF 110 transmits/receives data to/from an external computer such as a host computer via a network (not shown), and transmits/receives data to/from the CPU 102 via the bus 100.

The image drawing unit 114 draws an image based on an image forming signal inputted from the external computer or the like, and outputs the image to the CPU 102 and the RAM 124. Further, the process controller 116, together with the CPU 102, refers to set values and the like stored in the storage unit 104, and controls the image holder unit 26, the transfer unit 28, the exposure device and the like via the image forming IF 118. The sheet conveyance controller 120, together with the CPU 120, controls the feed roller 20, the retard roller 22, registration roller 24 and the like.

The toner filling unit 128 having, e.g., a motor is controlled by the CPU 102. The toner filling unit 128 drives a conveyance member provided in the first coupling member 66. The toner amount estimation unit 130 estimates the amount of toner filled in the first coupling member 66, and outputs the estimated toner amount to the CPU 102. More particularly, the toner amount estimation unit 130 estimates the toner amount based on an image density in a predetermined image area formed on the image holder 40. For example, when the density is a predetermined value, the toner amount estimation unit 130 estimates that the first coupling member 66 is fully filled with toner, and as the density becomes lowered, estimates that the toner amount is decreased. In this manner, the toner amount estimation unit 130 estimates the toner amount based on the density in image forming processing.

In the storage unit 104, the program ROM 122 has, e.g., a flash ROM. The program ROM 122 holds an execution program and set values to operate the image forming apparatus 10. The set values include, e.g., toner density parameter group, and image density parameter group. The toner density parameter group includes respective parameters related to toner density control in the developing devices 44. The image density parameter group includes respective parameters related to image density control on, e.g., the image holders 40.

The RAM 124 having, e.g., an SRAM holds information such as drawing data inputted from the image drawing unit 114. The main body NVM 126 has an electrically rewritable nonvolatile memory such as an EEPROM or a flash ROM. Note that the main body NVM 126 is a rewritable storage device which holds its storage content even when a power source is turned off (i.e., a nonvolatile memory). Note that the main body NVM 126 may be an SRAM or a hard disk drive optical memory with its power source backed up with a battery or the like.

The main body NVM 126 holds attachment records of the respective replacement units and respective life count values on the main body side. The attachment record of each replacement unit includes, e.g., a serial number and replacement time of the attached replacement unit. The life count values on the main body side respectively indicate the amount of use of the replacement unit of the image forming apparatus 10 from the start of use to the current time. The main body NVM 126 further holds a ratio (e.g. a preliminary warning ratio to be described later) to calculate replacement time of the developing material container 50, toner amounts corresponding to replacement time (e.g. a preliminary warning threshold value, a warning threshold value and a life over threshold value to be described later) of the developing material container 50.

Note that the main body NVM 126 may hold toner densities in the developing devices 44, image densities on the image holders 40, voltage values applied to the respective constituent elements, current values detected from the respective constituent elements (e.g. the transfer unit 28) and the like in a predetermined period.

Figure 3:
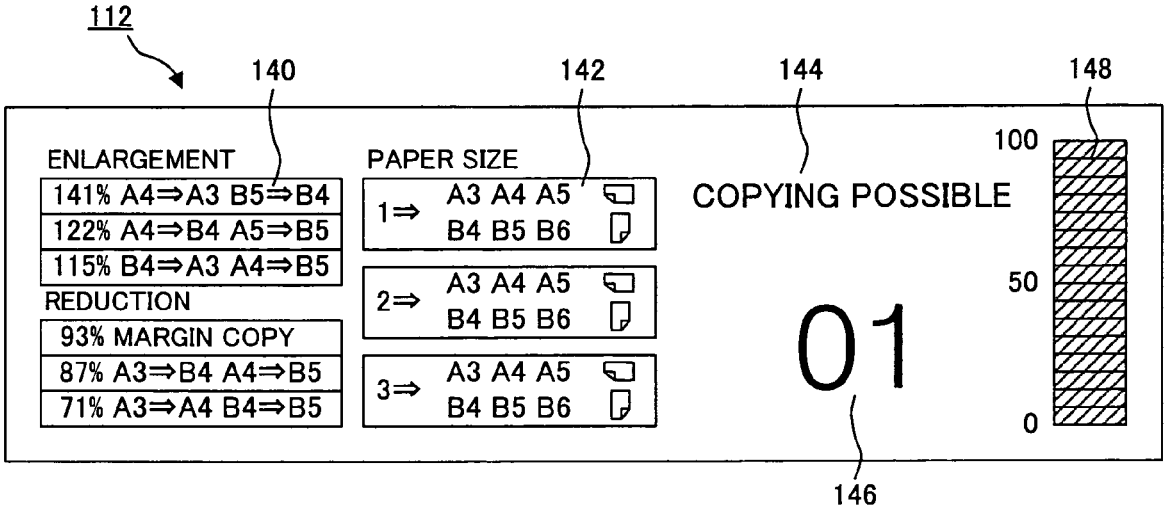
FIG. 3 is an example of display content displayed on a UI 112.

FIG. 3 is an example of display content displayed on a UI 112.

As shown in FIG. 3, a scaling ratio display 140, a paper size display 142, a message display 144, a number of print copies display 146 and a residual toner amount display 148. The scaling ratio display 140 displays scale factors for enlargement or reduction of image to be print-outputted. The paper size display 142 displays the size of recording medium on which the image is formed.

The message display 144 displays a status of the image forming apparatus 10 and a message based on the status. For example, the message display 144 displays a message "Replacement time of toner cartridge", a message "Toner cartridge nears replacement time" or the like based on the replacement time controlled by the controller 36.

The number of print copies display 146 displays the number of print copies. The residual toner amount display 148 displays a residual amount of toner in the developing material container 50. For example, the residual toner amount display 148 displays the residual toner amount as a bar-graph type level meter. Note that when the residual toner amount is 100%, the level meter is displayed to the top.

Figure 4A:
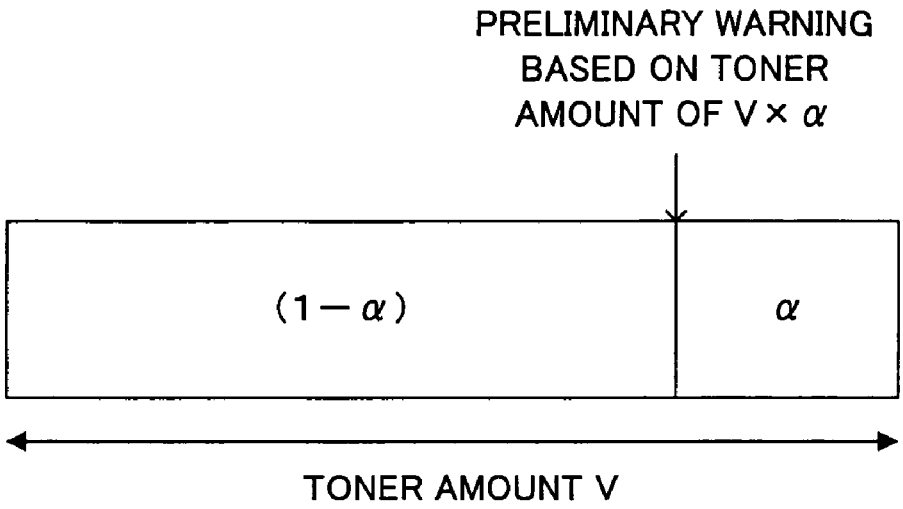
FIGS. 4A and 4B are explanatory diagrams showing a toner amount corresponding to replacement time of a developing material container 50 controlled by the controller 36 according to the first exemplary embodiment of the present invention.
Figure 4B:
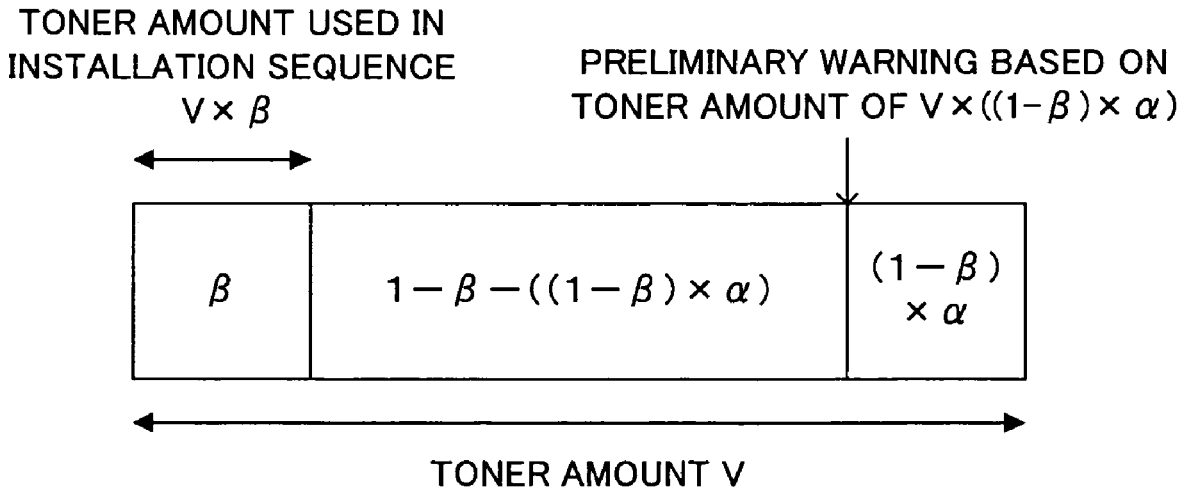

FIGS. 4A and 4B are explanatory diagrams showing a toner amount corresponding to the replacement time of the developing material container 50 (in this example, the preliminary warning threshold value) controlled by the controller 36 according to the first exemplary embodiment of the present invention. FIG. 4A shows a case where an installation sequence is not considered; and FIG. 4B, a case where the installation sequence is considered.

The installation sequence is an operation to fill the first coupling member 66 with toner contained in the supplied developing material container 52. It is determined whether or not the installation sequence is to be performed based on a toner amount in the first coupling member 66 estimated by the toner amount estimation unit 130. For example, when the image forming apparatus 10 is newly installed, the installation sequence is performed.

As shown in FIG. 4A, when the installation sequence is not considered, the preliminary warning threshold value is a value ($V\times\alpha$) obtained by multiplying a full toner amount V in the supplied developing material container 52 by a preliminary warning ratio $\alpha$. In this case, the controller 36 uses the following expression, and when the residual toner amount becomes less than the preliminary warning threshold value, the controller 36 performs preliminary warning.

$$\text{Residual toner amount} < V\times\alpha \quad (1)$$

For example, the preliminary warning ratio $\alpha$ is 0.25. The preliminary warning ratio $\alpha$ may be previously stored in at least one of the memory chip 56 of the developing material container 50 and the storage unit 104 of the controller 36. Otherwise, transmitted data on the ratio $\alpha$ may be received via the communication IF 110. Note that the preliminary warning ratio $\alpha$ may be given as a percentage ($\alpha\times100$).

The preliminary warning threshold value may be set for a toner consumption amount. In this case, the preliminary warning threshold value is $V\times(1-\alpha)$. The controller 36 uses the following expression, and when the toner consumption amount exceeds the preliminary warning threshold value, the controller 36 performs the preliminary warning.

$$\text{Toner consumption amount} > V\times(1-\alpha) \quad (2)$$

As shown in FIG. 4B, when the installation sequence is considered, a toner amount ratio $\beta$ (e.g., $\beta$=0.20) filled in the first coupling member 66 from the supplied developing material container 52 is considered. The toner amount ratio $\beta$ is calculated based on the number of revolutions of the toner filling unit 128 in the installation sequence.

The toner amount in the first coupling member 66 is a value ($V\times\beta$) obtained by multiplying a full toner amount V in the supplied developing material container 52 by a preliminary warning ratio $\beta$. Accordingly, the controller 36 uses the following expression, and when the residual toner amount becomes less that the preliminary warning threshold value, the controller 36 performs the preliminary warning.

$$\text{Residual toner amount} < V \times ((1-\beta) \times \alpha) \quad (3)$$

The preliminary warning value may be set for the toner consumption amount. In this case, the controller 36 uses the following expression, and when the toner consumption amount exceeds the preliminary warning threshold value, the controller 36 performs the preliminary warning.

$$\text{Toner consumption amount} > V \times (1-((1-\beta) \times \alpha) \quad (4)$$

In the controller 36 according to the present exemplary embodiment, the CPU 102 calculates the toner consumption amount based on the number of revolutions of the toner filling unit 128. More particularly, the CPU 102 calculates the toner consumption amount based on a total number of revolutions of the toner filling unit 128. As the toner amount in the first coupling member 66 is $V \times \beta$, the toner consumption amount is calculated with the following expression.

$$\text{Toner consumption amount} = \text{total number of revolutions of toner filling unit } 128 - V \times \beta \quad (5)$$

Accordingly, from the expressions (4) and (5), when the total number of revolutions of the toner filling unit 128 exceeds the preliminary warning threshold value ($V \times \beta + V \times (1-((1-\beta) \times \alpha))$, the CPU 102 performs the preliminary warning. Note that it may be arranged such that when the residual toner amount becomes less than the preliminary warning threshold value ($V \times \beta + V \times (1-((1-\beta) \times \alpha))$, the CPU 102 performs the preliminary warning.

Further, the CPU 102 calculates the warning threshold value corresponding to the replacement time of the developing material container 50. More particularly, the CPU 102 uses a warning ratio $\gamma(\gamma < \alpha)$, and when the total number of revolutions of the toner filling unit 128 exceeds the warning threshold value ($V \times \beta + V \times (1-((1-\beta) \times \gamma))$, the CPU 102 performs warning.

Further, the CPU 102 calculates the life over threshold value corresponding to the replacement time of the developing material container 50. The CPU 102 controls the life over threshold value based on the status of the first coupling member 66.

More particularly, when the installation sequence is not considered (i.e., when the first coupling member 66 is already fully filled with toner), the CPU 102 sets the life over threshold value to ($V \times \beta + V$). In this case, when the total number of revolutions of the toner filling unit 128 exceeds the life over threshold value ($V \times \beta + V$), the CPU 102 performs notification that the supplied developing material container 52 is empty.

When the installation sequence is considered (i.e., the first coupling member 66 is not filled with toner), the CPU 102 sets the life over threshold value to V. In this case, when the total number of revolutions of the toner filling unit 128 exceeds the life over threshold value V, the CPU 102 performs notification that the supplied developing material container 52 is empty. Note that when the developing material container 50 has been replaced, the total number of revolutions of the toner filling unit 128 is initialized.

In this manner, the CPU 102 of the controller 36 functions as a controller to control the replacement time of the developing material container 50 (the preliminary warning threshold value, the warning threshold value and the life over threshold value) based on the toner amount estimated by the toner amount estimation unit 130. The CPU 102 stores the controlled threshold value into at least one of the memory chip 56 of the developing material container 50 and the storage unit 104. Accordingly, the memory chip 56 of the developing material container 50 and the storage unit 104 function as a replacement time storage unit to hold the replacement time controlled by the CPU 102.

Figure 5:
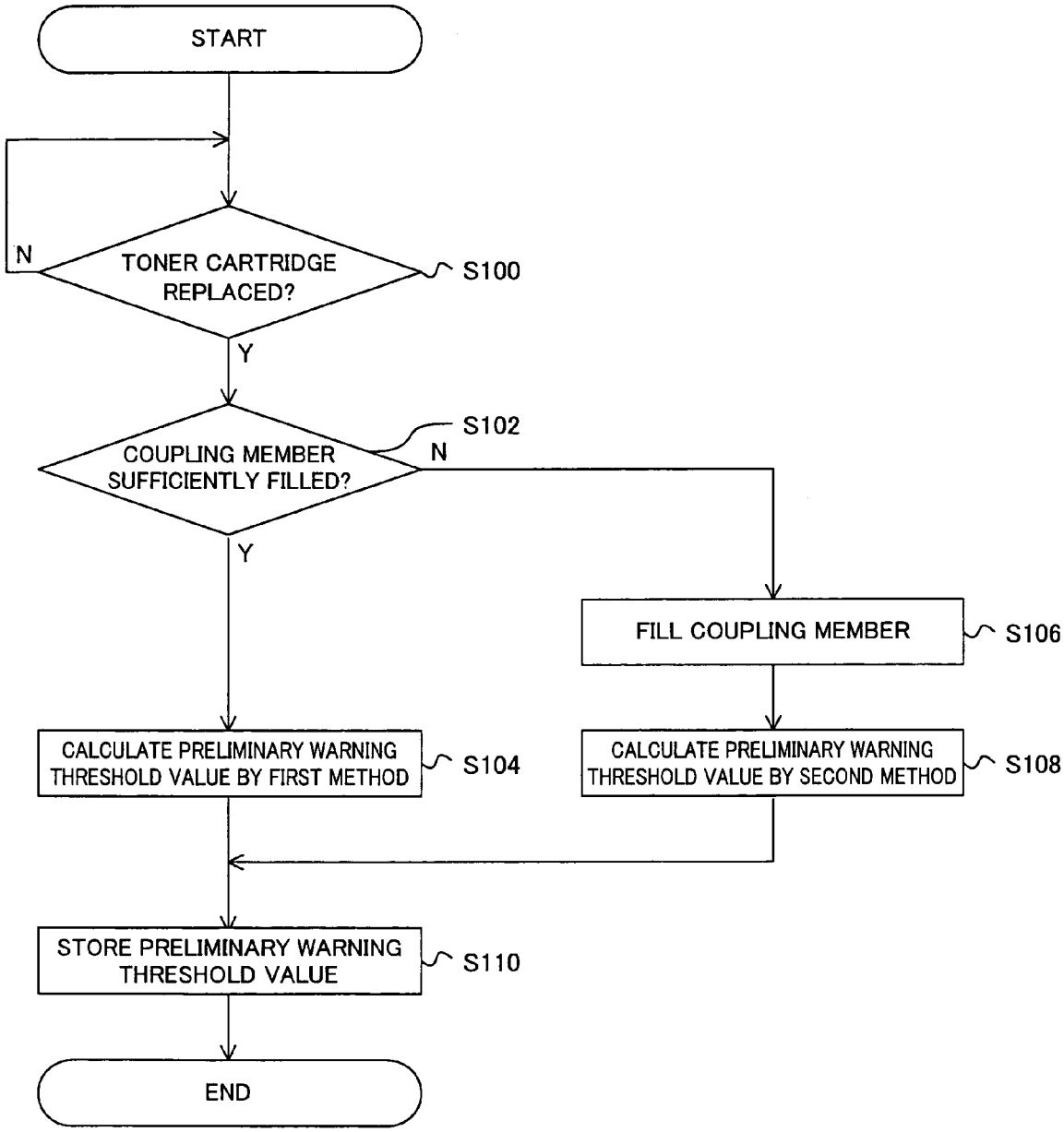
FIG. 5 is a flowchart showing preliminary warning threshold value calculation processing (S10) performed by the controller 36 according to the first exemplary embodiment of the present invention.

FIG. 5 is a flowchart showing preliminary warning threshold value calculation processing (S10) performed by the controller 36 according to the first exemplary embodiment of the present invention.

As shown in FIG. 5, in the controller 36, the replacement detection unit 106 determines whether or not replacement of the developing material container 50 has been detected. When the CPU 102 receives a signal indicating detection of replacement of the developing material container 50 from the replacement detection unit 106, the CPU 102 proceeds to step S102, otherwise, returns to step S100.

At step S102, the toner amount estimation unit 130 determines whether or not the first coupling member 66 is sufficiently filled with toner. More particularly, the toner amount estimation unit 130 determines whether or not the toner amount is equal to or greater than a predetermined value. When the CPU 102 receives a signal indicating that the first coupling member 66 is sufficiently filled with toner from the toner amount estimation unit 130, the CPU 102 proceeds to step S104, otherwise, proceeds to step S106.

At step S104, the CPU 102 calculates the preliminary warning threshold value by a first method. More particularly, the CPU 102 obtains the preliminary warning threshold value with respect to the toner consumption amount as $V \times (1-\alpha)$ based on the expression (2).

At step S106, the CPU 102 controls the toner filling unit 128 to sufficiently fill the first coupling member 66 with toner, thereby supplies toner from the supplied developing material container 52 of the developing material container 50 to the first coupling member 66.

At step S108, the CPU 102 calculates the preliminary warning threshold value by a second method. More particularly, the CPU 102 obtains the preliminary warning threshold value with respect to the toner consumption amount as $V \times \beta + V \times (1-(1-\beta) \times \alpha))$ based on the expressions (4) and (5).

At step S110, the CPU 102 stores the calculated threshold value into at least one of the storage unit 104 and the memory chip 56 of the developing material container 50.

In this manner, when at least one of the plural (four in this example) developing material containers 50 has been replaced, the controller 36 calculates the preliminary warning threshold value for the replaced developing material container 50. Similarly, the controller 36 calculates the warning threshold value and the life over threshold value. Note that the preliminary warning threshold value and the like are independently calculated in each color developing material container 50.

Figure 6:
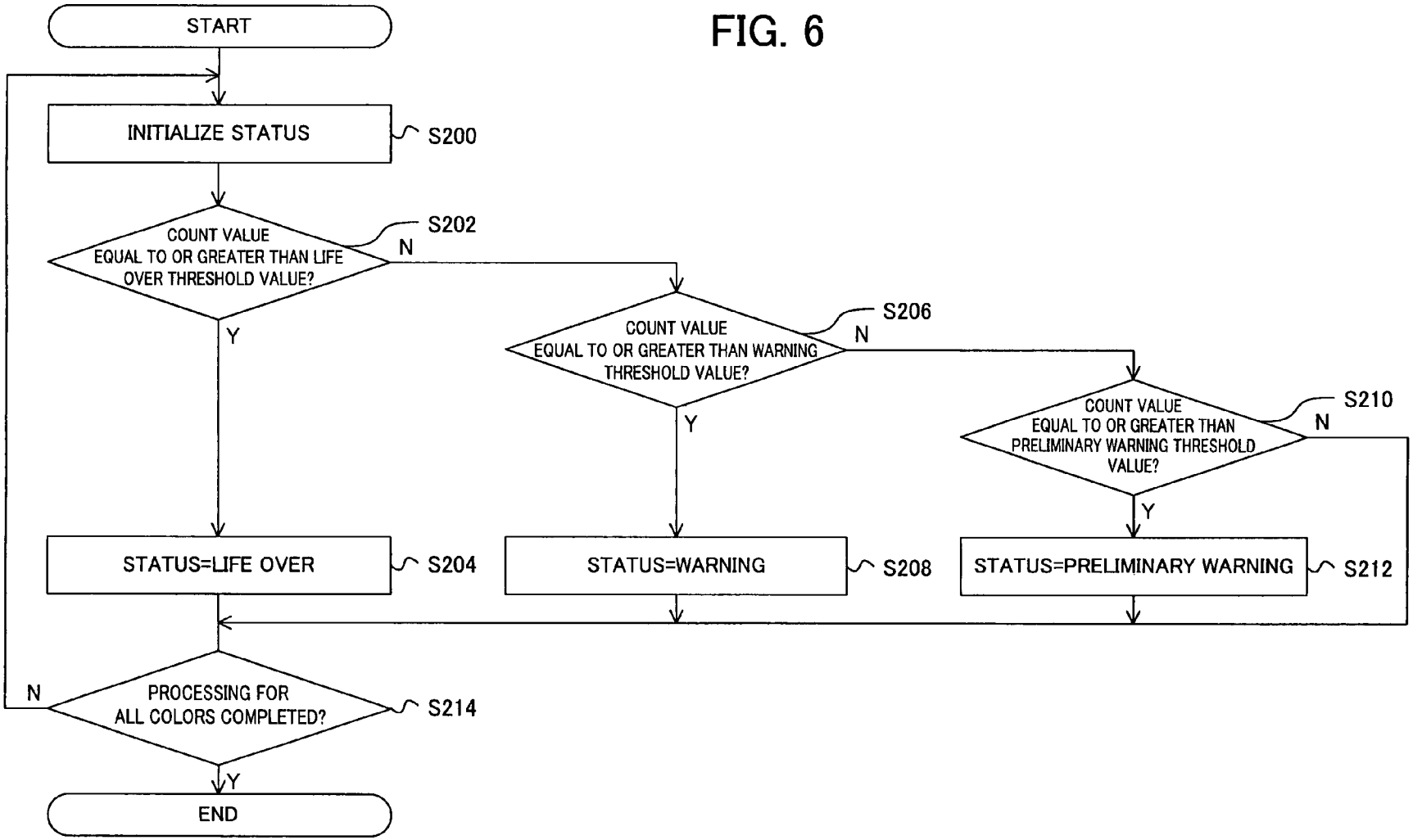
FIG. 6 is a flowchart showing processing of detecting the status of the developing material container 50 (S20) performed by the controller 36 according to the first exemplary embodiment of the present invention.

FIG. 6 is a flowchart showing processing of detecting the status of the developing material container 50 (S20) performed by the controller 36 according to the first exemplary embodiment of the present invention.

As shown in FIG. 6, at step S200, the CPU 102 of the controller 36 initializes a toner cartridge status (hereinafter simply referred to as a "status") of the developing material container 50. For example, the CPU 102 sets a predetermined value different from "preliminary warning", "warning" nor "life over" as the status.

At step S202, the CPU 102 determines whether or not the life count value corresponding to the toner consumption amount (e.g., the total number of revolutions of the toner filling unit 128, hereinafter, simply referred to as a "count value") exceeds the life over threshold value. When the count value exceeds the life over threshold value, the CPU 102 proceeds to step S204, otherwise, proceeds to step S206.

At step S204, the CPU 102 sets the status of the developing material container 50 to "life over".

At step S206, the CPU 102 determines whether or not the count value exceeds the warning threshold value. When the count value exceeds the warning threshold value, the CPU 102 proceeds to step S208, otherwise, process to step S210.

At step S208, the CPU 102 sets the status of the developing material container 50 to "warning".

At step S210, the CPU 102 determines whether or not the count value exceeds the preliminary warning threshold value. When the count value exceeds the preliminary warning threshold value, the CPU 102 proceeds to step S212, otherwise, proceeds to step S214.

At step S212, the CPU 102 sets the status of the developing material container 50 to "preliminary warning".

At step S214, the CPU 102 determines whether or not the status detection processing regarding the developing material containers 50 for all the colors has been completed. When the processing for all the colors has been completed, the CPU 102 terminates the processing, otherwise, returns to step S200 to perform the processing for the next color.

Figure 7:
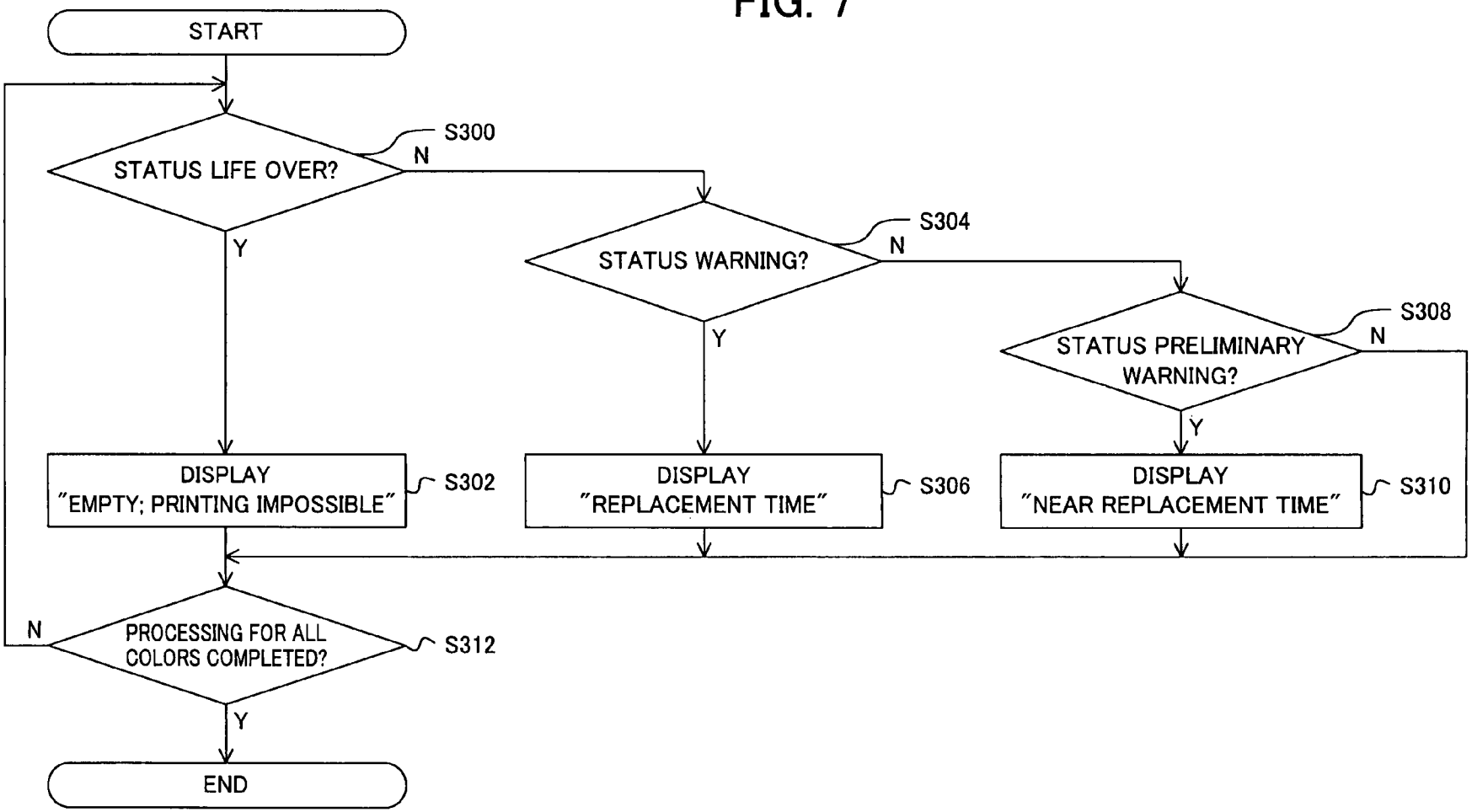
FIG. 7 is a flowchart showing status-based control processing (S30) performed by the controller 36 according to the first exemplary embodiment of the present invention.

FIG. 7 is a flowchart showing status-based control processing (S30) performed by the controller 36 according to the first exemplary embodiment of the present invention.

As shown in FIG. 7, at step S300, the CPU 102 of the controller 36 determines whether or not the status of the developing material container 50 is "life over". When the status is "life over", the CPU 102 proceeds to step S302, otherwise, proceeds to step S304.

At step S302, the CPU 102 displays a message "Printing is impossible; toner cartridge (color) is empty." on the message display 144. Note that the color is one of YCMK colors. In this case, it may be arranged such that the CPU 102 controls the UI 112 to illuminate a mark or the like indicating that the developing material container 50 is empty and printing is impossible.

At step S304, the CPU 102 determines whether or not the status of the developing material container 50 is "warning". When the status is "warning", the CPU 102 proceeds to step S306, otherwise, proceeds to step S308.

At step S306, the CPU 102 displays a message "Replacement time of toner cartridge (color)" on the message display 144 of the UI 112. In this case, it may be arranged such that the CPU 102 controls the UI 112 to illuminate a mark or the like indicating that it is replacement time of the developing material container 50.

At step S308, the CPU 102 determines whether or not the status of the developing material container 50 is "preliminary warning". When the status is "preliminary warning", the CPU 102 proceeds to step S310, otherwise, proceeds to step S312.

At step S310, the CPU 102 displays a message "Toner cartridge (color) nears replacement time" on the message display 144 of the UI 112. In this case, it may be arranged such that the CPU 102 controls the UI 112 to illuminate a mark or the like indicating that the developing material container 50 gets closer to the replacement time.

At step S312, the CPU 102 determines whether or not the status display processing regarding the developing material containers 50 for all the colors has been completed. When the processing has been completed for all the colors, the CPU 102 terminates the processing, otherwise, returns to step S300 to perform the processing for the next color.

Figure 8:
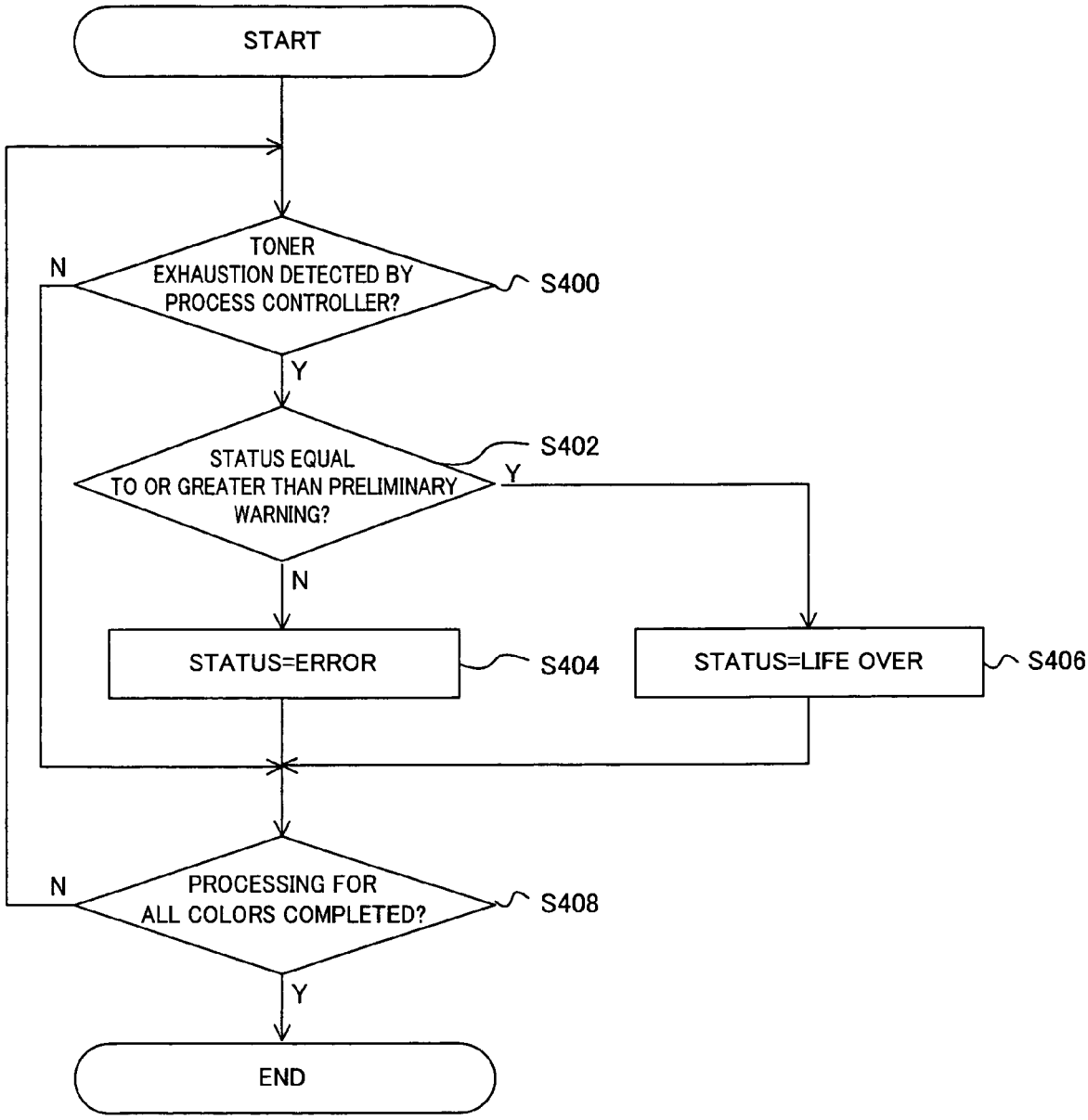
FIG. 8 is a flowchart showing status display processing (S40) performed by the controller 36 according to the first exemplary embodiment of the present invention.

FIG. 8 is a flowchart showing status-based control processing (S40) performed by the controller 36 according to the first exemplary embodiment of the present invention.

As shown in FIG. 8, at step S400, the CPU 102 of the controller 36 determines whether or not toner exhaustion has been detected in image forming processing. When toner exhaustion has been detected, the CPU 102 proceeds to step S402, otherwise, proceeds to step S408.

At step S402, the CPU 102 determines whether or not the status of the developing material container 50 is equal to or higher than "preliminary warning" (i.e., one of "preliminary warning", "warning" and "life over"). When the status is equal to or higher than "preliminary warning", the CPU 102 proceeds to step S406, otherwise, proceeds to step S404.

At step S404, the CPU 102 sets the status of the developing material container 50 to "error". Further, the CPU 102 displays error detection indication on the UI 112.

At step S406, the CPU 102 sets the status of the developing material container 50 to "life over".

At step S408, the CPU 102 determines whether or not the status-based control processing regarding the developing material containers 50 for all the colors has been completed. When the processing for all the colors has been completed, the CPU 102 terminates the processing, otherwise, returns to step S400 to perform the processing for the next color.

Note that the processing at step S404 is not limited to the error indication, and the cleaning cycle of the cleaning device 48 may be changed, or necessary set values in the image forming processing may be changed. In this case, the set values regarding control of the transfer unit 28, the developing device 44 and the like, the exposure amount, and the like, may be changed.

Further, in the image forming apparatus 10 according to the present exemplary embodiment, the developing material container 50 is used as a replacement unit, however, the replacement unit is not limited to the developing material container 50. For example, the fixing device 30, the transfer unit 28, the image holder unit 26, the charging device 42, the developing device 44, the cleaning device 48, the recovered developing material container 54, the optical writing device and combinations thereof may be used as replacement units.

Next, the image forming apparatus 10 according to a second exemplary embodiment of the present invention will be described.

The image forming apparatus 10 according to the present exemplary embodiment is different from the first exemplary embodiment in that the toner amount in the first coupling member 66 is calculated based on the status of the image forming apparatus 10 stored in the storage unit 104.

More particularly, in the controller 36 according to the present exemplary embodiment, the main body NVM 126 further holds information on execution/nonexecution of installation sequence, operation status (e.g. the number of revolutions) of the toner filling unit 128 and the like. The CPU 102 calculates the toner amount in the first coupling member 66 based on the execution/nonexecution of installation sequence, the number of revolutions of the toner filling unit 128, image density on the image holder 40 and the like.

Figure 9:
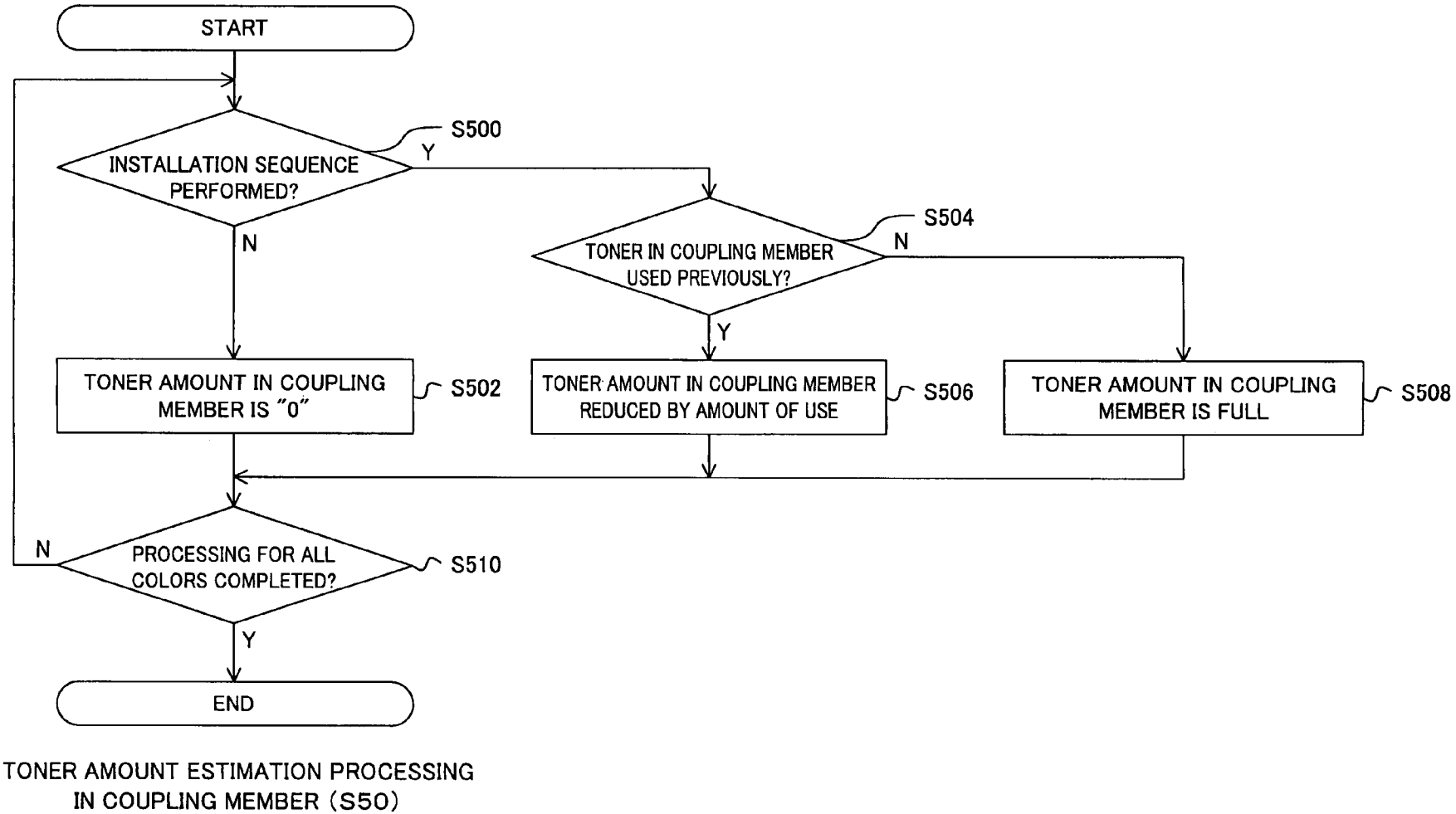
FIG. 9 is a flowchart showing toner amount estimation processing in a first coupling member 66 (50) performed by the controller 36 according to a second exemplary embodiment of the present invention.

FIG. 9 is a flowchart showing toner amount estimation processing in the first coupling member 66 (S50) performed by the controller 36 according to the second exemplary embodiment of the present invention.

As shown in FIG. 9, at step S500, the CPU 102 of the controller 36 refers to the main body NVM 126 of the storage unit 104, and determines whether or not the installation sequence has been performed. When the installation sequence has been performed, the CPU 102 proceeds to step S502, otherwise, proceeds to step S504.

At step S502, the CPU 102 calculates the toner amount in the first coupling member 66 as "0". That is, the CPU 102 determines it is necessary to supply toner corresponding to the capacity of the first coupling member 66 from the supplied developing material container 52 so as to sufficiently fill the first coupling member 66 with toner.

At step S504, the CPU 102 determines whether or not the toner in the first coupling member 66 is used in image forming processing when the previous (pre-replacement) developing material container 50 is attached to the image forming apparatus main body 12. For example, the CPU 102 performs determination based on the image density on the image holder 40 stored in the main body NVM 126. When the toner in the first coupling member 66 is used in the image forming processing, the CPU 102 proceeds to step S506, otherwise, proceeds to step S508.

At step S506, the CPU 102 calculates the toner amount in the first coupling member 66 as an amount used in developing from the full status.

At step S508, the CPU 102 determines that the toner amount in the first coupling member 66 is full.

At step S510, the CPU 102 determines whether or not the toner amount estimation processing in the first coupling member 66 has been completed regarding the developing material container 50 for all the colors. When the processing has been completed for all the colors, the CPU 102 terminates the processing, otherwise, returns to step S500 to perform the processing for the next color.

Next, the image forming apparatus 10 according to a third exemplary embodiment of the present invention will be described.

The image forming apparatus 10 according to the present exemplary embodiment is different from the first exemplary embodiment in that the developing material container 50 is provided with a CPU.

Figure 10:
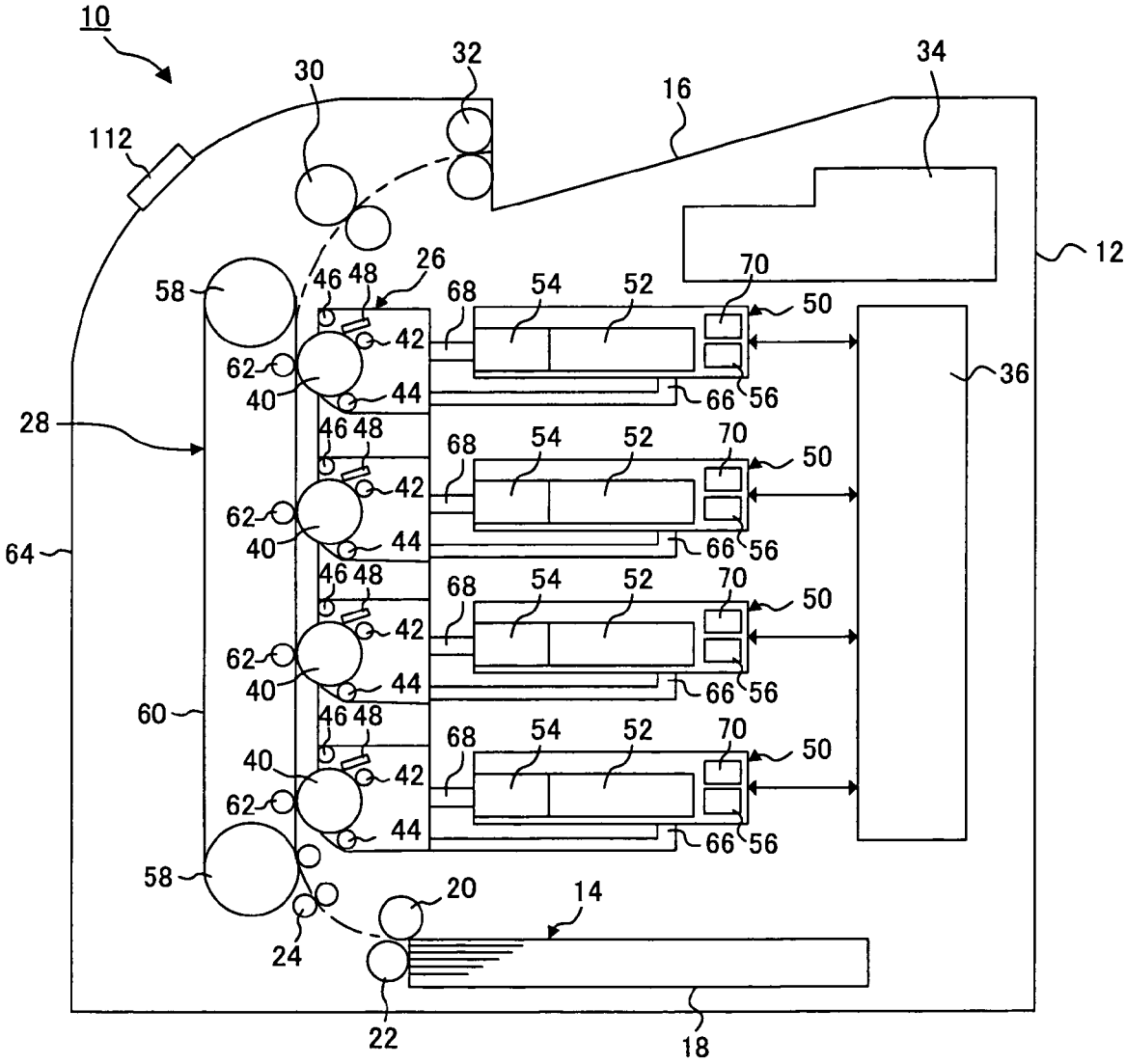
FIG. 10 is a cross-sectional view showing the image forming apparatus 10 according to a third exemplary embodiment of the present invention.

FIG. 10 is a cross-sectional view showing the image forming apparatus 10 according to the third exemplary embodiment of the present invention.

As shown in FIG. 10, the image forming apparatus 10 according to the present exemplary embodiment has the developing material container 50 provided with a CPU 70.

The CPU 70 functions as a controller which inputs/outputs a signal to/from the controller 36 to control the replacement time of the developing material container 50. The CPU 70 performs the preliminary warning threshold value calculation processing (S10; FIG. 5). The CPU 70 outputs the calculated preliminary warning threshold value, the warning threshold value and the life over threshold value to the controller 36.

Next, an image forming system 1 including the image forming apparatus 10 according to a fourth exemplary embodiment of the present invention will be described.

Figure 11:
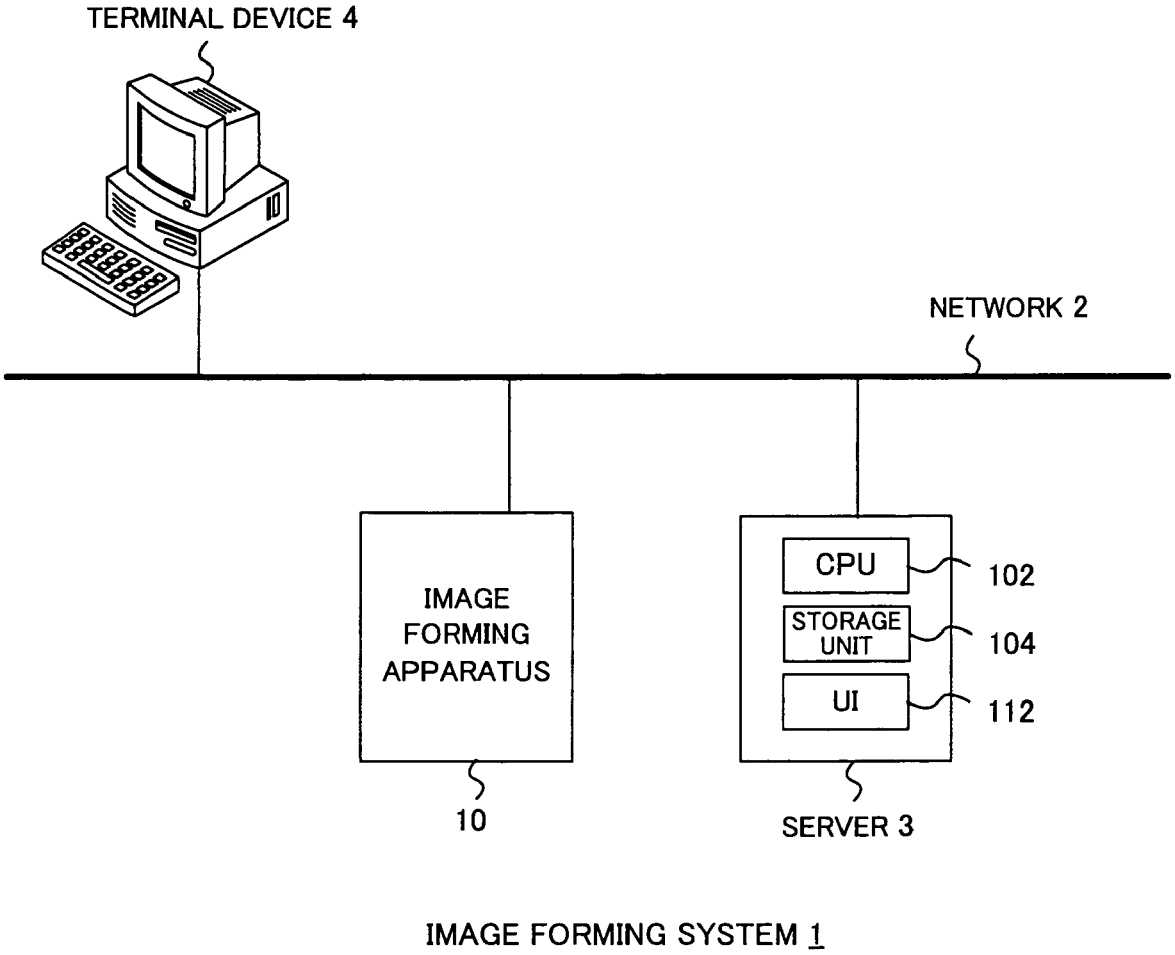
FIG. 11 is a block diagram showing an image forming system 1 including the image forming apparatus 10 according to a fourth exemplary embodiment of the present invention.

FIG. 11 is a block diagram showing the image forming system 1 including the image forming apparatus 10 according to the fourth exemplary embodiment of the present invention. Note that among the respective constituent elements shown in FIG. 11, elements substantially the same as those shown in FIGS. 1 and 2 have the same reference numerals.

As shown in FIG. 11, the image forming system 1 includes a server 3, a terminal device 4 and the image forming apparatus 10. The image forming apparatus 10 and the like are interconnected via a network 2 such as a LAN or WAN, and mutually perform data transmission/reception.

In the image forming system 1, the terminal device 4 is a personal computer (PC) in which a predetermined driver software program is installed. The terminal device 4 transmits a print request, including image data in which characters, graphics and the like are described in a predetermined page description language or the like, via the network 2 to the image forming apparatus 10.

The server 3 has a controller including the CPU 102, the storage unit 104, the UI 112 and the like. The server 3 transmits/receives data on replacement time of the developing material container 50 provided in the image forming apparatus 10 to/from the image forming apparatus 10. The storage unit 104 in the server 3 holds a ratio to calculate replacement time of the developing material container 50 provided in the image forming apparatus 10 and calculated replacement time such as preliminary warning threshold value.

The CPU 102 in the server 3 calculates the replacement time such as the preliminary warning threshold value based on the ratio such as preliminary warning ratio stored in at least one of the image forming apparatus 10 and the server 3. Note that data on numerical value necessary for calculation is transmitted/received to/from the image forming apparatus 10 via the network 2.

Further, the UI 112 of the server 3 displays a predetermined message based on the replacement time of the developing material container 50 provided in the image forming apparatus 10 under the control of the CPU 102.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising: a developing device; a replaceable developing material container that contains developing material; a coupling member that couples the developing device to the developing material container; a controller that, when the developing material container is attached and an installation sequence to fill the coupling member with developing material is performed, calculates a value obtained by performing an operation to calculate replacement time of the developing material container, on a developing material amount obtained by subtracting a developing material amount filled in the coupling member from a developing material amount contained in the attached developing material container; a ratio storage unit that holds a ratio for calculation of the replacement time of the developing material container, wherein the controller calculates the replacement time of the developing material container based on the ratio stored in the ratio storage unit; and a display that displays information indicating the replacement time of the developing material container based on the value calculated by the controller.

2. An image forming apparatus comprising: a developing device; a replaceable developing material container that contains developing material; a coupling member that couples the developing device to the developing material container; a controller that, when the developing material container is attached and an installation sequence to fill the coupling member with developing material is performed, calculates a value obtained by performing an operation to calculate replacement time of the developing material container, on a developing material amount contained in the attached developing material container after the installation sequence, while when the installation sequence is not performed, calculates a value obtained by performing the operation on a developing material amount in the developing material container upon attachment; a ratio storage unit that holds a ratio for calculation of the replacement time of the developing material container, wherein the controller calculates the replacement time of the developing material container based on the ratio stored in the ratio storage unit; and a display that displays information indicating the replacement time of the developing material container based on the value calculated by the controller.

3. An image forming apparatus comprising: a developing device; a replaceable developing material container that contains developing material; a coupling member that couples the developing device to the developing material container; a developing material amount estimation unit that estimates a developing material amount included in the coupling member; and a controller that, when the developing material container is replaced, calculates replacement time of the developing material container based on a developing material amount obtained by subtracting the developing material amount estimated by the developing material amount estimation unit from the developing material amount contained in the developing material container, and a ratio storage unit that holds a ratio for calculation of the replacement time of the developing material container, wherein the controller calculates the replacement time of the developing material container based on the ratio stored in the ratio storage unit.

4. The image forming apparatus according to claim 3, wherein the controller determines the replacement time of the developing material container based on an expression threshold value $=V\times\beta+V((1-\beta)\times\alpha)$, wherein V is the developing material amount contained in the developing material container, $\beta$ is a developing material amount ratio filled in the coupling member from the developing material container, $\alpha$ is a preliminary warning ratio.

5. The image forming apparatus according to claim 3, wherein the controller controls a threshold value to calculate the replacement time of the developing material container based on a status of the coupling member.

6. The image forming apparatus according to claim 3, further comprising a display that displays information indicating the replacement time of the developing material container based on the replacement time of the developing material container calculated by the controller.

7. The image forming apparatus according to claim 3, further comprising an image forming unit that forms an image on a recording medium in correspondence with the replacement time of the developing material container controlled by the controller.

8. The image forming apparatus according to claim 3, wherein the developing material amount estimation unit estimates the developing material amount based on a status of the image forming unit.

9. The image forming apparatus according to claim 3, wherein the developing material amount estimation unit estimates the developing material amount based on a density in image forming processing by the image forming unit.

10. The image forming apparatus according to claim 3, wherein the image forming unit changes control based on a status of the developing material container determined based on the replacement time of the developing material container calculated by the controller.

11. The image forming apparatus according to claim 3, wherein the coupling member has a conveyance unit that conveys the developing material, and the developing material amount estimation unit estimates the developing material amount included in the coupling member based on a driving status of the conveyance unit.

12. An image forming system comprising: a developing device; a replaceable developing material container that contains developing material; a coupling member that couples the developing device to the developing material container; a controller that, when the developing material container is attached and an installation sequence to fill the coupling member with developing material is performed, calculates a value obtained by performing an operation to calculate replacement time of the developing material container, on a developing material amount obtained by subtracting a developing material amount filled in the coupling member from a developing material amount contained in the attached developing material container; a ratio storage unit that holds a ratio for calculation of the replacement time of the developing material container, wherein the controller calculates the replacement time of the developing material container based on the ratio stored in the ratio storage unit; and a display that displays information indicating the replacement time of the developing material container based on the value calculated by the controller.

13. An image forming system comprising: a developing device; a replaceable developing material container that contains developing material; a coupling member that couples the developing device to the developing material container; a controller that, when the developing material container is attached and an installation sequence to fill the coupling member with developing material is performed, calculates a value obtained by performing an operation to calculate replacement time of the developing material container, on a developing material amount contained in the attached developing material container after the installation sequence, while when the installation sequence is not performed, calculates a value obtained by performing the operation on a developing material amount in the developing material container upon attachment; a ratio storage unit that holds a ratio for calculation of the replacement time of the developing material container, wherein the controller calculates the replacement time of the developing material container based on the ratio stored in the ratio storage unit; and a display that displays information indicating the replacement time of the developing material container based on the value calculated by the controller.

14. An image forming system comprising:

a developing device;

a replaceable developing material container that contains developing material;

a coupling member that couples the developing device to the developing material container;

a developing material amount estimation unit that estimates a developing material amount included in the coupling member;

a ratio storage unit that holds a ratio for calculation of the replacement time of the developing material container; and a controller that, when the developing material container is replaced, calculates the replacement time of the developing material container based on a developing material amount obtained by subtracting the developing material amount estimated by the developing material amount estimation unit from the developing material amount contained in the developing material container and the ratio stored in the ratio storage unit.

15. An image forming system comprising: a developing device; a replaceable developing material container that contains developing material; a coupling member that couples the developing device to the developing material container; a developing material amount estimation unit that estimates a developing material amount included in the coupling member; a controller that, when the developing material container is replaced, calculates replacement time of the developing material container based on a developing material amount obtained by subtracting the developing material amount estimated by the developing material amount estimation unit; and unit from the developing material amount contained in the developing material container; a ratio storage unit that holds a ratio for calculation of the replacement time of the developing material container, wherein the controller calculates the replacement time of the developing material container based on the ratio stored in the ratio storage unit; and a display that displays a message based on the replacement time of the developing material container calculated by the controller.

* * * * *